United States Patent [19]

Reibling

[11] 4,384,318

[45] May 17, 1983

[54] TASK LIGHT

[75] Inventor: Robert L. Reibling, Ft. Thomas, Ky.

[73] Assignee: Kidde Consumer Durables Corp., Bala Cynwyd, Pa.

[21] Appl. No.: 219,789

[22] Filed: Dec. 24, 1980

[51] Int. Cl.[3] ..... F21S 5/00

[52] U.S. Cl. ..... 362/216; 362/290; 362/342; 362/346; 362/354; 362/362

[58] Field of Search ..... 362/33, 216, 217, 290, 362/325, 342, 354, 362, 346

[56] References Cited

U.S. PATENT DOCUMENTS

| | | | |
|---|---|---|---|
| 2,591,251 | 4/1952 | Gilman . | |
| 2,683,799 | 7/1954 | Taylor et al. . | |
| 2,745,001 | 5/1956 | Guth . | |
| 3,094,287 | 6/1963 | Lester | 362/216 |
| 3,169,710 | 2/1965 | Lipscomb . | |
| 3,187,660 | 6/1965 | Lazerson . | |
| 3,733,482 | 5/1973 | Miller | 362/216 |
| 4,222,094 | 9/1980 | Wolar | 362/290 |
| 4,254,449 | 3/1981 | Benasutti | 362/216 |

FOREIGN PATENT DOCUMENTS 944201 12/1963 United Kingdom .

*Primary Examiner*—Donald P. Walsh

*Attorney, Agent, or Firm*—Seidel, Gonda, Goldhammer & Panitch

[57] ABSTRACT

A task lighting apparatus produces glare-free illumination of a work area. The apparatus includes a light source, a reflector and light-directing louvers to provide a controlled light pattern of high illumination levels and high efficiency. The apparatus has a compact size and shape which enables it to be used in confined quarters.

7 Claims, 4 Drawing Figures

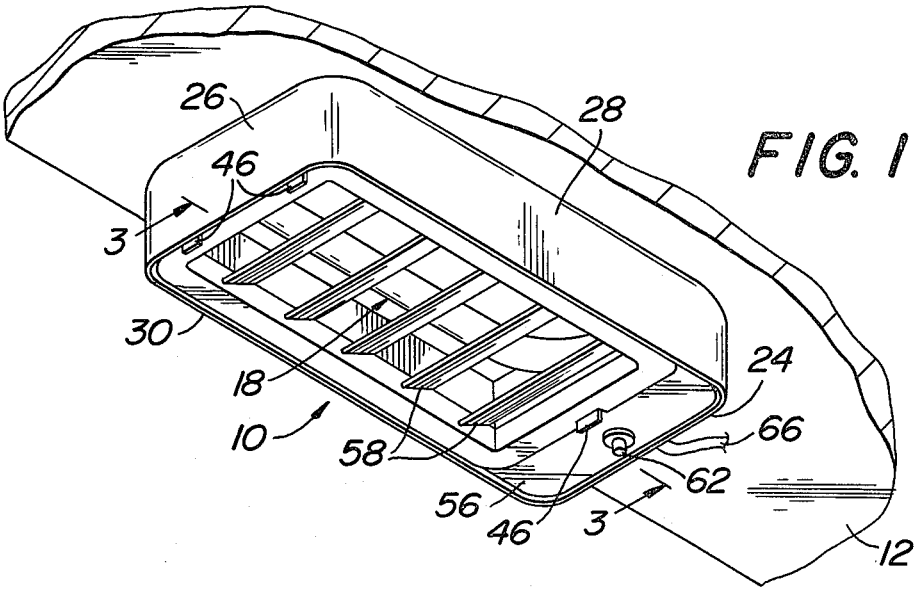
FIG. 1
FIG. 3
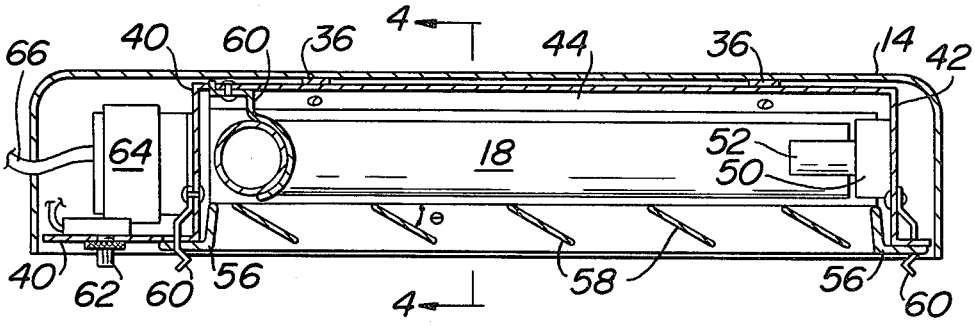
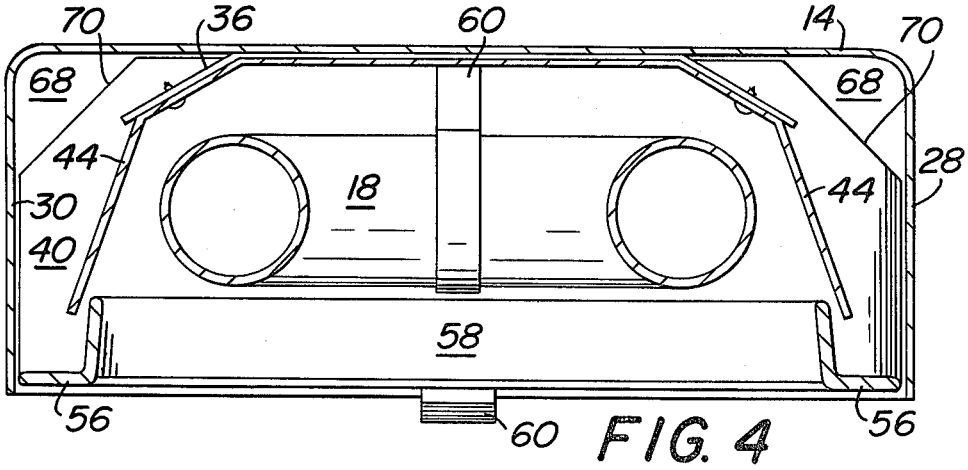
FIG. 4

TASK LIGHT

BACKGROUND OF THE INVENTION

Task lighting is lighting supplementary to general ambient lighting to provide additional illumination of a work surface, such as, for example, a work bench or a counter top. Work surfaces located under cabinets or shelves will have much of the ambient lighting blocked out. Therefore, a task light is necessary to adequately illuminate those surfaces. Also, many times the ambient lighting is insufficient to provide adequate illumination of a work surface, and, therefore, a task light is necessary to supplement the ambient lighting.

Ideally, a task light must perform two major functions: (1) it must increase the overall illumination level on the work surface, and (2) it must produce a glare-free visual environment. In addition, the ideal task light must have other attributes, such as a low profile, high light output and efficient optical system.

Prior task light designs incorporate one or two fluorescent lamp tubes in lengths ranging from 9 inches to 48 inches. The lamp was either exposed or was mounted in an enclosure having a clear lens, a prismed lens or an "egg-crate" baffle. Such task light fixtures are typically mounted under cabinets or shelves or are suspended above the work surface, and extend laterally along most of the length of the work surface. Such fixtures usually provide adequate illumination, but do not address the problem of glare control. When such fixtures are located directly in an angular line with the eye, objectionable reflective glare will be experienced. This is annoying and tiring to the viewer.

Although reflectors and louvers have long been used in lighting fixtures, prior designs have never been able to achieve both major functions of a task light. For example, U.S. Pat. No. 2,591,251 teaches the use of vertical baffles arranged in a typical "egg-crate" configuration. U.S. Pat. No. 2,683,799 teaches the use of both angled reflectors and vertical louvers with prismatic surfaces which gradually taper down along the length of the louver. U.S. Pat. No. 2,745,001 also teaches the use of vertical louvers to difuse the light. The configuration disclosed in a latice configuration at specific dimensions. U.S. Pat. No. 3,169,710 is very similar to U.S. Pat. No. 2,745,001 but is not as specific in describing the latice configuration. U.S. Pat. No. 3,187,660 also teaches the use of an angled reflector. British Pat. No. 944,201 teaches the use of angled louvers of prismatic form arranged vertically, similar to U.S. Pat. No. 2,683,799. None of the prior art devices achieve a controlled, glare-free illumination pattern.

SUMMARY OF THE INVENTION

The task light fixture of the present invention consists of three major components: a housing, a chassis and a louver assembly. The housing has an open bottom. The chassis is supported in the housing and includes an open bottom reflector. The reflector is arranged and shaped to direct lumen output of a light source in zonal segments for vertical and lateral distribution. A light source is supported in the housing beneath the reflector. A louver assembly is supported adjacent the open bottom of the housing. The louver assembly is arranged so that it can direct portions of the lumen output from the light source in a plurality of inclined planes.

An object of the present invention is to provide increased illumination of a work surface without also producing objectionable glare.

Another object of the present invention is to provide increased, glare-free illumination in a fixture having a low profile, high light output and an efficient optical system. A further object of the present invention is to provide a task light fixture having mechanical flexibility to adapt to various methods of mounting, for example, under shelves, on walls, free standing, clamp-on and pendent mounting.

For the purpose of illustrating the invention, there is shown in the drawing a form which is presently preferred; it being understood, however, that this invention is not limited to the precise arrangements and instrumentalities shown.

DESCRIPTION OF THE DRAWINGS

FIG. 1 is a perspective view of the present invention.

FIG. 3 is a longitudinal sectional view taken along the line 3—3 in FIG. 1.

FIG. 4 is a sectional view taken along the line 4—4 in FIG. 3.

DETAILED DESCRIPTION OF THE INVENTION

Figure 2:
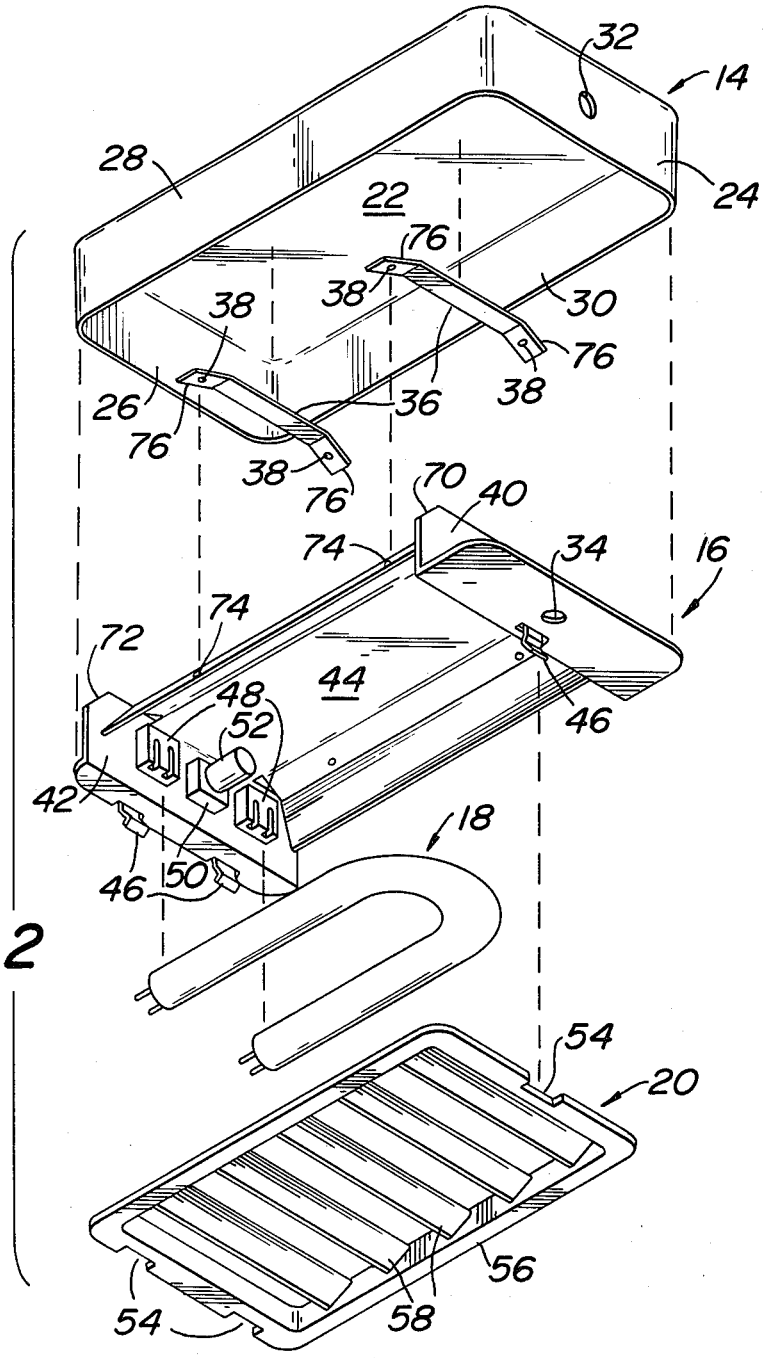
FIG. 2 is an exploded view of the light fixture.

Referring to the drawings, wherein like numerals indicate like elements, there is shown in FIG. 1 a task light fixture 10 in accordance with the present invention and mounted on the bottom surface of a support 12. The support 12 may be a shelf, the bottom of a cabinet mounted on a wall, or the like. Fixture 10 has a low profile whereby its height in elevation is approximately 2 to 2½ inches. As shown more clearly in FIG. 2, task light fixture 10 consists of three major components, namely a housing 14, a chasis 16, and a louver assembly 20.

Housing 14 is made in one piece of sheet metal or plastic and has a top wall 22 connected to end walls 24 and 26 and side walls 28 and 30. End wall 24 has a hole 32 for accommodating electrical wiring as will be made clear hereinafter. At least one and preferably two spacers or brackets 36 are riveted or otherwise secured at their middle zone to top wall 22 within housing 14. Each spacer or bracket 36 has downwardly angled end portions 76 and extends transversely of the housing 14 as shown in FIGS. 2 and 4.

Chassis 16 is preassembled as a unit and includes end walls 40 and 42 interconnected by a reflector 44. End wall 40 has beveled corners 70 which cooperate with the inner surface of housing 14 to define wireways 68. The upper corners 72 of end wall 42 are similarly beveled. End wall 40 has a hole 34 for accommodating an electrical switch as will be made clear hereinafter. A spring clip 46 is mounted in the center portion of end wall 40. As shown most clearly in FIG. 3, an electrical ballast 64 for the light source 18 is secured to end wall 40.

As shown in FIGS. 2 and 3, an electrical socket 50 is mounted in the center of end wall 42. A starter 52 for light source 18 is removably mounted in socket 50. Two electrical sockets 48 for light source 18 are mounted on end wall 42 on either side of socket 50. Two spring clips 46 are secured to end wall 42 and are located approximately below sockets 48.

End wall 40 and end wall 42 are interconnected by reflector 44. As shown most clearly in FIG. 4, reflector 44 has a cross-section which is a symmetrical stepped angular shape to redirect the light output of light source 18 in zonal segments. Reflector 44 is provided with mounting holes 74 which cooperate with holes 38 in spacers 36 to enable chassis 16 to be mounted within housing 14.

Light source 18 is a conventional fluorescent tube in the shape of a U. The U-shape configuration permits maximum light output in a minimum amount of space. By way of example, the light source 18 would typically have a wattage rating of 15 W or 25 W and a preferred length of 9 to 10 inches. Light source 18 is mounted in sockets 48, which are mounted on end wall 42 of chassis 16.

Louver assembly 20 is an integral one-piece structure of sheet metal or plastic. Louver assembly 20 consists of a frame 56 which supports a plurality of louvers 58. The louvers 58 are attached to frame 56 so that the angle $\theta$ between the plane of the louvers 58 and the longitudinal axis of the task light 10 is about 30°. Louver assembly 20 is provided with three suitable openings 54 to engage the spring clips 46 in chassis 16 for removably securing louver assembly 20 to chassis 16. It is preferred that the louver assembly 20 have a chromed surface finish which is highly specular in appearance, or have reflectivity equal to a specular alzak finish on aluminum.

As shown in FIG. 3, an electrical switch 62 is mounted to end wall 40 of chassis 16. Switch 62 is a typical on/off switch for light source 18. Electrical power is provided to the task light 10 by means of electrical conductor 66, which is connected to ballast 64 in the conventional manner. A clip 60 is mounted to reflector 44 in the center portion of the end of reflector 44 adjacent end wall 40. Clip 60 removably secures light source 18 to chassis 16.

In use, the angular stepped shaped of reflector 44 directs the light output of light source 18 in zonal segments for vertical and lateral distribution. The louver assembly 20 redirects portions of the light generated by light source 18 in a plurality of inclined planes, so that the vertical beam component (0° axis) of the light has maximum candle power at 40° and the lateral beam component (90° axis) has maximum candle power at 30°. The combination of light source 18, reflector 44 and louver assembly 20 produces a controlled light pattern shape of high efficiency and illumination levels, while also providing beam direction and cut off to eliminate glare.

It will be appreciated that the present invention performs the two major task lighting functions, increased illumination and elimination of glare.

The present invention may be embodied in other specific forms without departing from the spirit or essential attributes thereof and, accordingly, reference should be made to the appended claims, rather than to the foregoing specification, as indicating the scope of the invention.

I claim:

1. A task light fixture comprising:

(a) a housing having an open bottom;

(b) a chassis supported in said housing, said chassis including a reflector comprising a series of angular stepped sections arranged for directing lumen output in zonal segments for vertical and lateral distribution;

(c) a light source supported in said chassis beneath said reflector; and (d) a louver assembly adjacent said open bottom of said housing for directing portions of the lumen output of said light source in a plurality of inclined planes.

2. A task light fixture as in claim 1, wherein said light source is a U-shaped fluorescent tube.

3. A lighting apparatus as in claim 1, wherein said louver assembly comprises a plurality of louvers disposed at an acute angle to the plane of said light source.

4. A task light fixture as in claim 3, wherein said angle is 30°.

5. A task light fixture as in claim 4, wherein said louver assembly has a chromed surface finish which is highly specular.

6. A task light fixture comprising:

(a) a housing having an open bottom;

(b) a chassis supported in said housing, said chassis including a reflector comprising a series of angular stepped sections, arranged for directing lumen output in zonal segments for vertical and lateral distribution;

(c) a U-shaped fluorescent tube supported in said housing beneath said reflector; and (d) a louver assembly comprising a plurality of louvers disposed at an angle of about 30° to the plane of said U-shaped fluorescent tube and adjacent said open bottom of said housing for directing portions of the lumen output of said U-shaped fluorescent tube in a plurality of inclined planes, wherein the vertical beam component (0° axis) has maximum candle power at 40° and the lateral beam (90° axis) has maximum candle power at 30°.

7. A task light fixture comprising:

(a) an elongated low profile housing having an open bottom;

(b) a chassis supported in said housing, said chassis including end walls and a reflector arranged for directing lumen output in zonal segments for vertical and lateral distribution, said reflector constituting the structure interconnecting said end walls of said chassis, a U-shaped light source supported by said chassis beneath said reflector and having legs extending longitudinally of said housing, said reflector comprising a series of stepped angular sections, said light source being removably coupled to said chassis; and (c) a louver assembly adjacent said open bottom of said housing for directing portions of the lumen output of said light source in a plurality of inclined planes, said louver assembly including inclined louvers transverse with respect to the legs of said light source, and cooperating means on said chassis and louver assembly for removably attaching said louver assembly to the chassis.

* * * * *